United States Patent [19]

Klaus et al.

[11] Patent Number: 4,509,668

[45] Date of Patent: Apr. 9, 1985

[54] PNEUMATICALLY OPERABLE FASTENER DRIVING TOOL

[75] Inventors: Artur Klaus, Frankfurt am Main; Hans Wilhelm, Bad Vilbel, both of Fed. Rep. of Germany

[73] Assignee: Signode Corporation, Glenview, Ill.

[21] Appl. No.: 436,485

[22] Filed: Oct. 25, 1982

[30] Foreign Application Priority Data

Oct. 24, 1981 [DE] Fed. Rep. of Germany ..... 3142237

[51] Int. Cl.[3] ..... B25L 1/04

[52] U.S. Cl. ..... 227/8; 227/130

[58] Field of Search ..... 227/8, 130, 120, 156

[56] References Cited

U.S. PATENT DOCUMENTS

| | | | |
|---|---|---|---|
| 3,713,573 | 1/1973 | Fehrs | 227/8 |
| 4,165,676 | 8/1979 | Siegmann | 227/8 X |
| 4,194,664 | 3/1980 | Siegmann | 227/8 |
| 4,339,065 | 7/1982 | Haytayan | 227/8 |
| 4,384,668 | 5/1983 | Tutomu et al. | 227/8 |

FOREIGN PATENT DOCUMENTS

| | | | |
|---|---|---|---|
| 1204418 | 9/1970 | United Kingdom | 227/8 |

*Primary Examiner*—Paul A. Bell

*Attorney, Agent, or Firm*—Allen J. Hoover

[57] ABSTRACT

The present invention relates to a pneumatically operable fastener driving tool which uses a safety device which prevents the operation of the tool until it is in engagement with the workpiece. More particularly, the safety mechanism includes a safety nose that is normally retained in a retracted position prior to the tool being operated. When the tool is to be operated, the safety nose is extended to be engaged by the workpiece. Subsequent engagement of the safety nose by the workpiece permits the trigger mechanism to effect driving movement of the driver. The mechanism includes a first valve which controls the flow of high-pressure air to the driving piston and a second valve which controls the flow of air to the safety mechanism. The trigger mechanism initially operates the second valve to move the safety nose to the operative position and when the safety nose engages the workpiece it effects operation of the first valve to control the operation of the driving piston.

9 Claims, 11 Drawing Figures

PNEUMATICALLY OPERABLE FASTENER DRIVING TOOL

BACKGROUND OF THE INVENTION

This invention is concerned with a pneumatically operable fastener driving tool, e.g. a nail driving tool, having a compressed air store space for actuating a driver piston displaceably disposed in a cylinder and carrying on the bottom side thereof a driving pin guided in an output barrel, with a valve assembly including for example, a membrane valve and having a pressure application chamber being provided which by means of a manually operable control valve via a displaceable control piston, in the resting position, is in communication with the compressed air store space and, in the operating position, is in communication with the atmosphere.

Tools of this type are involved with the problem of a risk of injury if the operating lever for releasing the shot, i.e. for expelling the fastener, e.g. the nail, inadvertently, is released, for example, during the transport of the tool by hitting a solid article. It is true, there is the possibility of providing a locking mechanism for the actuating lever that is respectively operated after each use of the tool. However, experience has shown that this is frequently omitted by negligence or out of laziness. A safety nose protruding beyond the tool mouth is little suitable not only because a peril to the operator cannot be excluded as the safety nose during the operation or the transport, by inadvertence, can push somewhere against something, but also because application of the tool to the workpiece is rendered complicated in that the safety nose must already be in a pushed-in state, i.e. already ready for shooting, before the mouth of the tool is firmly applied to the workpiece. Safety noses protruding beyond the mouth equally have a detrimental effect with such tools in which for hole finding a nail or the like fastener is advanced over the mouth of the tool, as is, for example, described by DE-OS No. 28 31 055. A nail protruding from the tool mouth, for example, cannot be safely pushed into a hole of a steel plate to be secured to wood if at the same time, an equally protruding safety nose is hindering. Moreover, as a rule, it is very difficult and force-consuming to push back the nail into the tool mouth to thereby place also the safety nose into the position required for releasing the driving operation.

It is, therefore, an object of the present invention to provide a driving tool of the afore-mentioned type in which the disadvantages as described are avoided and which includes an easily operable and reliably working safety mechanism to prevent an inadvertent shooting of the fastener.

The basic conception of solution according to the invention resides in providing a safety mechanism the safety nose of which will not have to protrude beyond the mouth of the tool when the tool is applied to precise point of the nail, but pressure is rather applied only briefly before the release in the direction of disengaged position to scan the presence of the work as the final requirement for the driving operation.

This problem is solved by the present invention. In the manual operation of the control valve lever, compressed air from the compressed air store space via a safety filling valve is applied to a safety nose against the action of a reset spring to displace the safety nose from a retracted position into a position protruding beyond the front end of the output barrel. After the safety nose meets with a resistance of a predetermined force or a non-resilient surface of a corresponding force having been mounted, the compressed air from the compressed air store space is closed off from the pressure application chamber and the pressure application chamber is connected with the atmosphere.

With the aid of the safety mechanism of the invention a shooting of the fastener will thus be possible only if either the fastener driving tool upon operation of the control valve lever with the mouthpiece including the opening of the output barrel is already mounted to a surface offering an adequate resistance, i.e. the working face, so that the safety nose cannot be pushed beyond the front end of the output barrel or that the fastener driving tool subsequently, is pushed back to the said working face by pushing back the safety nose to the level of the forward end of the output barrel. For putting into operation the safety mechanism of the invention the compressed air stock of the tool is utilized.

In a special embodiment of the invention, the control valve comprises a safety valve assembly which during manual operation of the control valve lever connects a channel between a safety piston cylinder arrangement, in the resting position, to the atmosphere and, in the operating position, to the compressed air store space, with the safety piston cylinder assembly expanding under the action of the compressed air thereby advancing the safety nose against the action of the reset spring.

If according to another embodiment of the inventive conception, the part of the safety piston cylinder assembly, e.g. the safety piston, displaceable relative to the safety nose is displaced against the action of another reset spring by means of the compressed air from the compressed air store space on account of the fact that the safety nose strikes a surface exhibiting a resistance of a predetermined amount and on account of that the safety nose is retained or pushed back into an actuating position only thereby displacing the control piston of the control valve from its resting position into its operating position, it can be safeguarded that a shot can be released only upon overcoming the force determined by the further reset spring which is thus apt to retain or push back the safety nose. Accordingly, by a special selection of this further reset spring, the response point of the safety mechanism of the invention can be determined more precisely. Feasibly, the safety cylinder is displaceably disposed on the tool housing and is connected to the safety nose via an operating arm.

The safety piston with the end of its piston rod can be guided in a tool housing chamber and can support there against the further reset spring.

In this connection, it is of special advantage for a simple construction if the piston rod includes an axial bore which on the one hand terminates in the front face of the safety piston and on the other hand terminates in the connecting channel to the safety valve assembly.

If in accordance with another embodiment of the invention the piston rod, possibly via a lateral lug and a swing strap of the control valve lever, upon the displacement of the safety piston against the action of the further reset spring with the control valve lever being actuated, acts upon the control piston of the control valve in the sense of a ventilation of the pressure application chamber,, it is reliably safeguarded that the control valve for the pressure drop in the pressure application chamber and thus the release of the shot will be possible only if the safety piston cylinder assembly has come into operation beforehand.

The safety valve assembly can include a safety valve piston which by way of the control valve lever is displaceable from the resting position in which it releases the connecting channel to the atmosphere, into the operating position in which it releases the connecting channel to the compressed air store space. The control piston may have a continuous axial, longitudinal bore, can form with the one end thereof, the sealing face for abutment to a sealing seat and with the other end thereof can immerse into a chamber of the safety valve piston. The path of movement of the safety valve piston and that of the control piston are thus identical so that the two pistons are operable by one and the same control valve lever.

The chamber in the operated position of the safety valve piston via bores is in flow communication with the connecting channel of the safety piston cylinder assembly.

If according to another embodiment of the invention, the control piston in the operating end position, on the one hand, with the sealing face thereof abuts the sealing seat and on the other hand, supports itself on the safety valve piston, or with the front face thereof in which terminates its axial longitudinal bore, in the chamber, and the safety valve piston supports itself on the swing strap of the control valve lever and the latter on the piston rod of the safety piston, an easy and reliable way of operation of the safety mechanism of the invention is safe-guarded.

In another safety mechanism according to the inventive conception it is provided—starting from a fastener driving tool of the generic type—that the store chamber via an adjustable throttle valve is in communication with the atmosphere and via a connecting channel is in communication with a safety piston cylinder, with the safety piston cylinder arrangement expanding under the action of the compressed air thereby displacing the safety nose against the action of the reset spring. It is only as long as the store space has the required pressure for displacing the safety nose against the reset spring or for maintaining the same displaced, that a release of a shot is possible. On account of the adjustment of the throttle valve this time interval can be preselected. After this period of time having lapsed an inadvertent release of a shot will no longer be possible. It is only when the operator again operates the safety filling valve between compressed air store space and store chamber that the fastener driving tool will again become ready for shooting. The time during which the required pressure in the store chamber is maintained for safety reasons can thus be dimensioned relatively short so that the risk of the inadvertent release of a shot after using the tool continues to exist only for this short period of time at the most. Conversely, in case of a desired extended duration of use of the tool, the throttle valve can be so adjusted that the required operating pressure is maintained for a sufficiently long period of time with no need for a frequent use of the safety filling valve.

On account of the fact that the safety nose strikes a surface exhibiting a resistance of a predetermined force, in this embodiment at least the part of the safety piston cylinder assembly, e.g. the safety piston, displaceable relative to the safety nose, against the action of another reset spring by means of compressed air from the store chamber and on account of the safety nose being retained or pushed back is pushed into an operating position in which only upon manual operation of the control valve lever, the same acts, possibly via a swing strap raised by the safety piston cylinder assembly, e.g. the safety piston, on the control piston of the control valve in the sense of a displacement from the resting position into the operating position thereby safeguarding of necessity that the operation of the control lever and thus displacement of the control piston of the control valve, from the resting position into the operating position releasing the shot will be possibly only if an adequately large resistance is offered to the safety nose by striking or touching a solid surface during advancement which, in turn, will be possible only if the required operating pressure prevails in the store chamber.

Also, in this form of embodiment, the safety cylinder can be displaceably disposed on the tool housing and connected to the safety nose via an operating arm; moreover, the safety piston with the end of the piston rod thereof can be guided in a tool housing chamber and can support there against the further reset spring; furthermore, the piston rod can comprise an axial bore that on the one hand terminates in the front surface of the safety piston and on the other hand terminates in the connecting channel to the store chamber and, finally, the piston rod, possibly via a lateral lug and a swing strap of the control valve lever upon displacement of the safety piston against the action of the further reset spring upon operation of the control valve lever can act upon the control piston of the control valve in the sense of a ventilation of the pressure application chamber as is also the case with the first described form of embodiment.

For a better understanding of the present invention, reference is had to the following description of forms of embodiment taken in connection with the accompanying drawing. In this connection, all features described and/or illustrated, by themselves or in any desired reasonable combination form the subject matter of the present invention even irrespective of the combination thereof in the claims or the dependence thereof.

Figures 7, 7A:
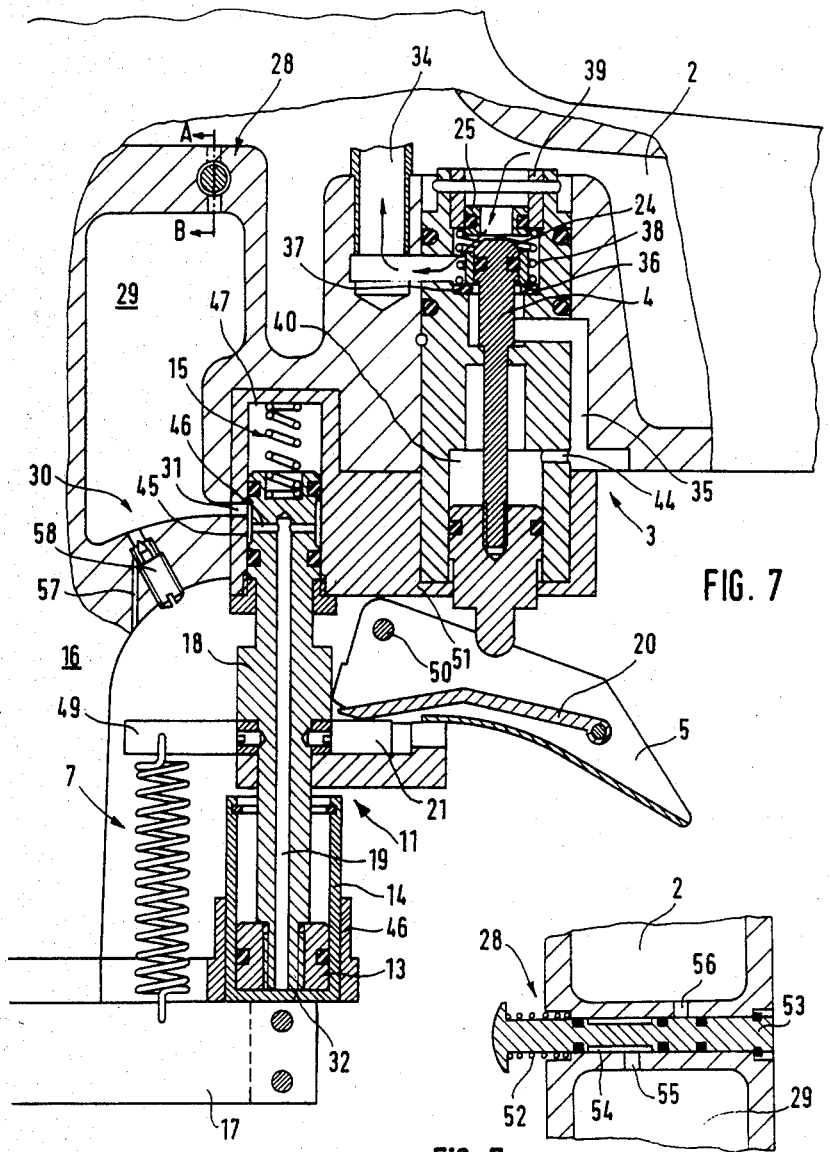
FIG. 7 schematically shows in section the safety mechanism in a fastener driving tool of the invention in accordance with a further form of embodiment.
Figures 8, 8A:
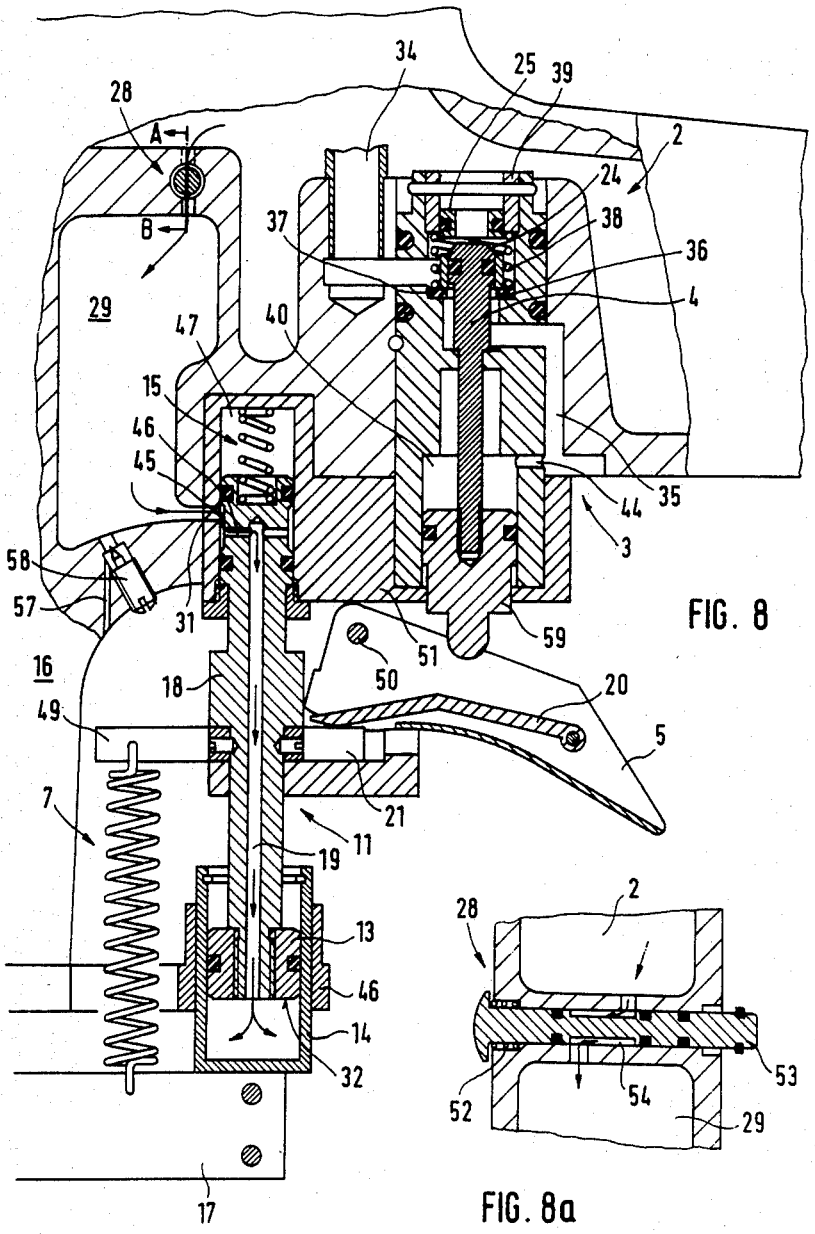
Figure 9:
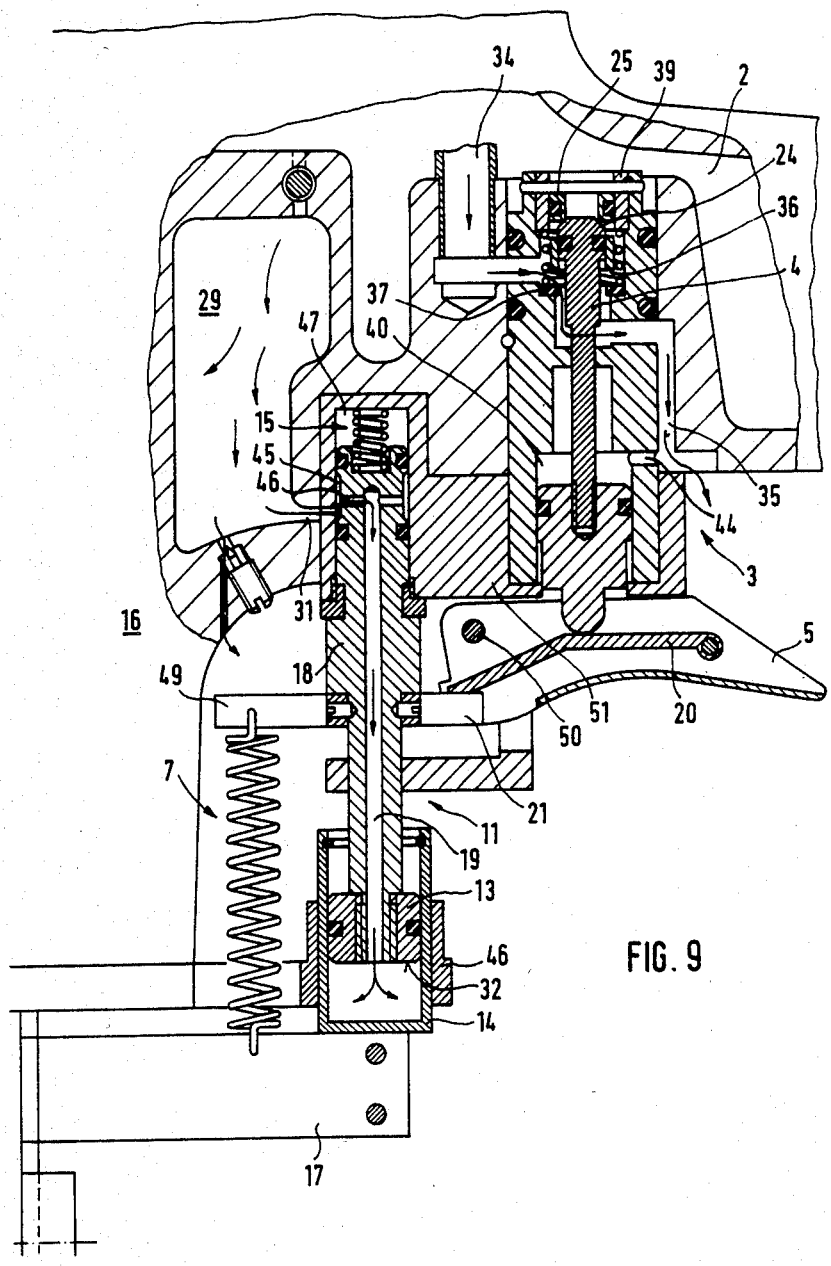

FIG. *7a* is an enlarged section along A-B of FIG. 7 through the safety filling valve in closed condition;

FIG. 8 is an illustration according to FIG. 7 in which the safety mechanism is in a position prior to the shot with the nose moved out;

FIG. 8*a* is an enlarged section along A-B of FIG. 8 through the open filling valve between air store space and store chamber, and FIG. 9 is an illustration according to FIG. 7, in which the safety mechanism is in the shooting position.

DETAILED DESCRIPTION OF THE PREFERRED EMBODIMENT

The invention will now be described by way of the examples of embodiment as illustrated in FIGS. 1 through 6, by the structural build-up and the way of operation of the fastener driving tool 1. The fastener driving tool 1 has a tool housing 16 which downwardly passes over into a mouthpiece 33. Also enclosed by housing 16 is a compressed air store chamber 2 which, like a handle laterally branches off from the main space enclosed by housing 16. As, for example, in the tool according to DE-OS No. 23 50 859, the main chamber encloses a cylinder in which a driver piston is disposed in a vertically displaceable manner which on the bottom side thereof carries a driver guided in an output barrel enclosed by mouthpiece 33. For applying the required operating pressure to the driver piston, a valve assembly comprising, for example, a membrane valve and having a pressure application chamber is provided in the main chamber enclosed by the tool housing 16. In the pressure application chamber via a control valve 3 open in the resting position and manually operable and a connecting tube 34 the operating pressure in the compressed air store space 2 is maintained. As long as this operating pressure on the membrane valve assembly is maintained the operating pressure of the pressure application chamber 2 is hindered to expel the driver piston with the driving pin and thus the fastener, e.g. the nail, from the forward end 8 of the output barrel. In the fastener driving tool according to DE OS No. 23 50 859 upon manual operation of the control valve 3 by displacement of a control piston the flow communication between pressure application chamber 2 and connecting tube 34 is discontinued and is established in place via a venting duct 35 between pressure application chamber and atmosphere. This involves a pressure relief of the pressure application chamber and an opening of the membrane valve assembly and a sudden pressure application to the driver piston by the operating pressure of the compressed air store space 2, i.e. the shot is released upon actuation of a control valve lever 5 and displacement caused thereby of the control piston of the control valve 3 is directly effected. On account of this indirect action of the control valve lever 5 on the control piston, the risk of an inadvertent release of a shot exists.

Figure 1:
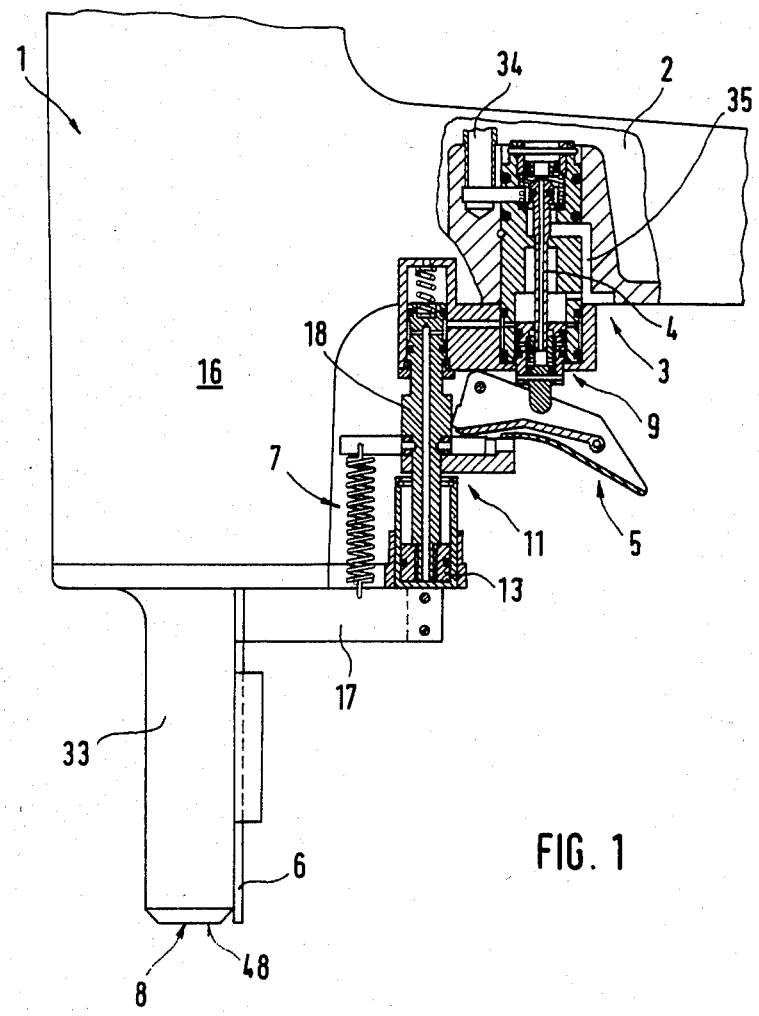
FIG. 1 shows the fastener drive tool of the invention, partly broken away and partly in section, with the safety mechanism being in the resting position.
Figure 2:
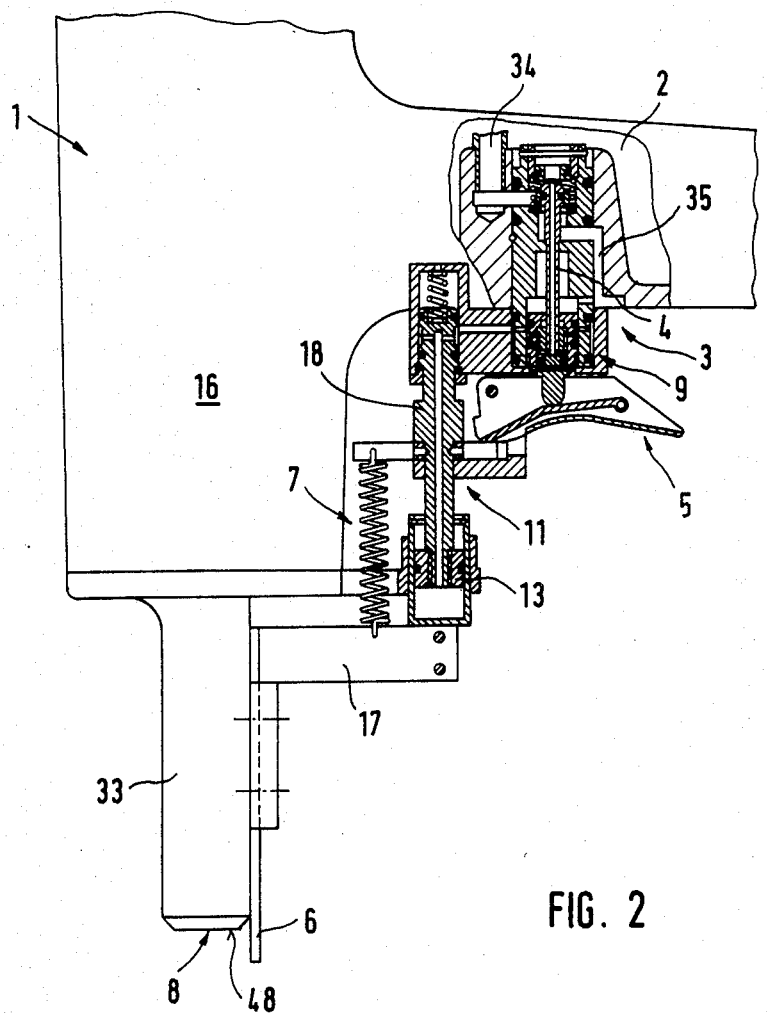
FIG. 2 is a demonstration according to FIG. 1 in which the safety mechanism is in a position prior to the shot, with the safety nose being moved out.
Figure 3:
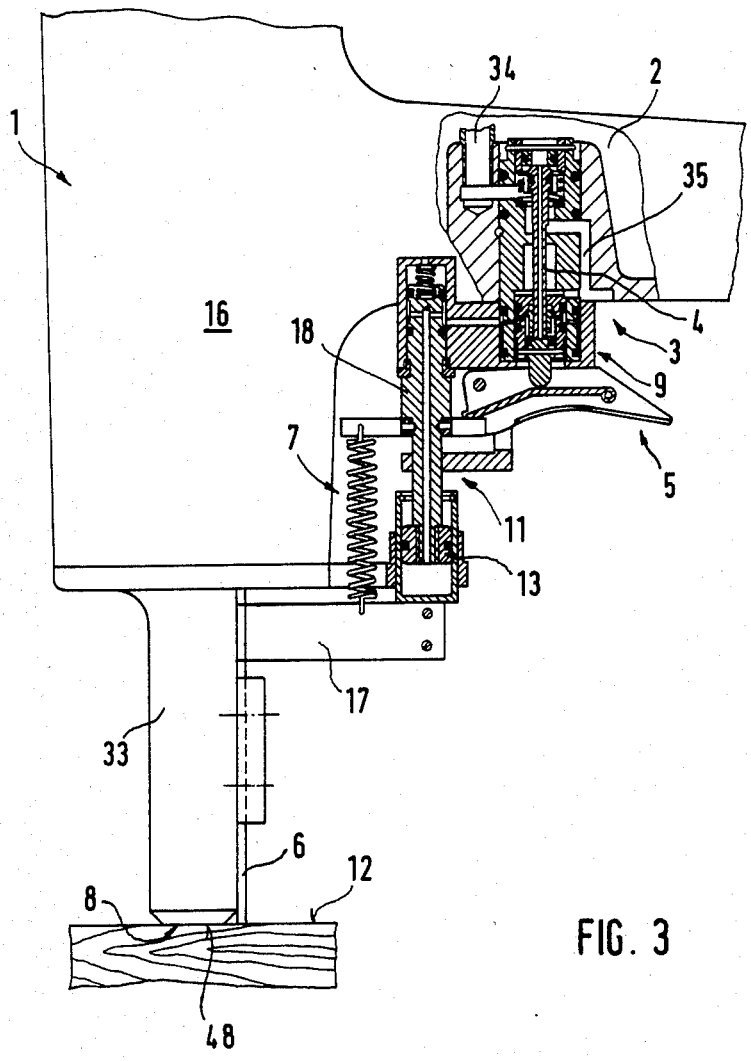
FIG. 3 is an illustration according to FIG. 1 in which the safety mechanism is in shooting position, i.e. in a position of the safety nose pushed back or retained by a solid working face.
Figure 4:
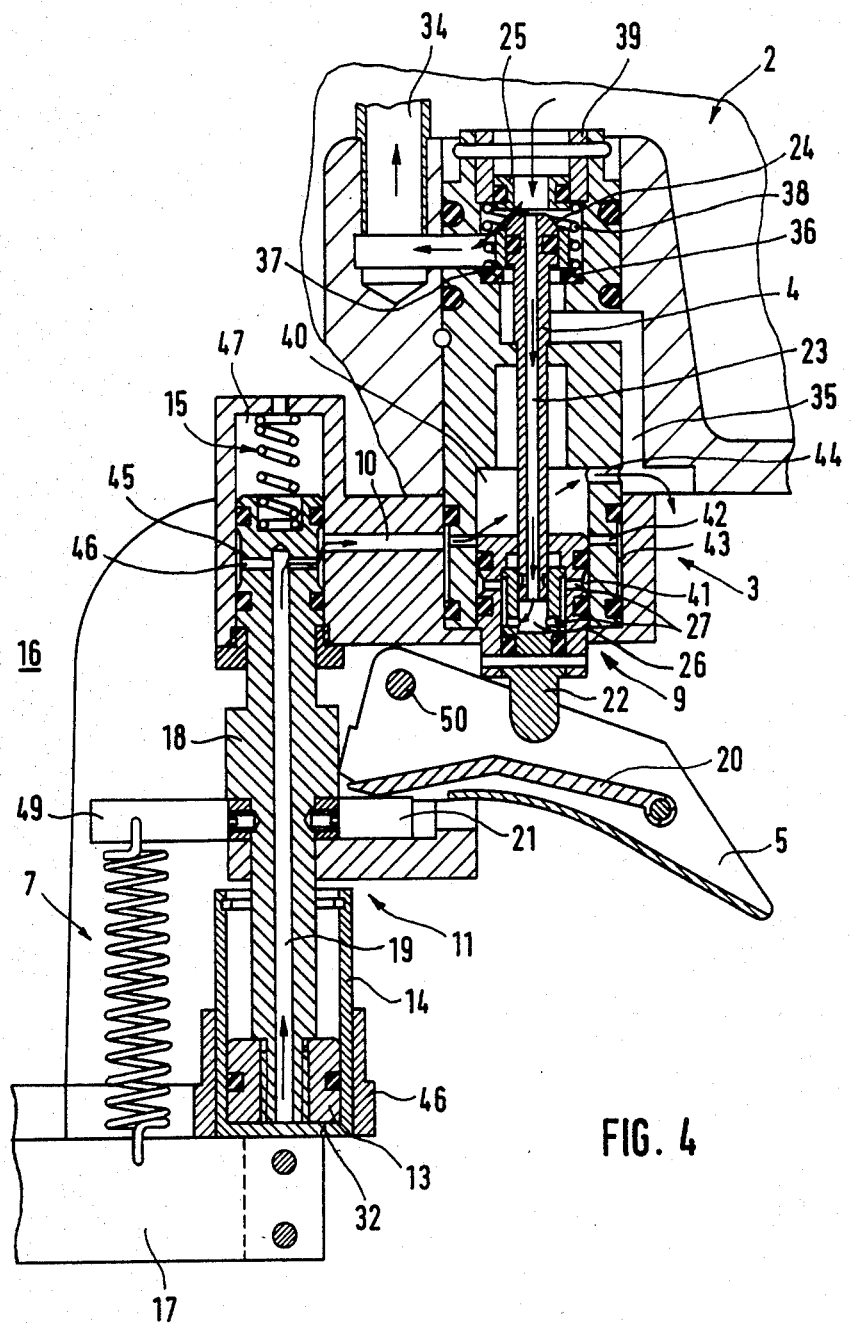
FIG. 4 is an enlarged illustration of the safety mechanism in the resting position.
Figure 5:
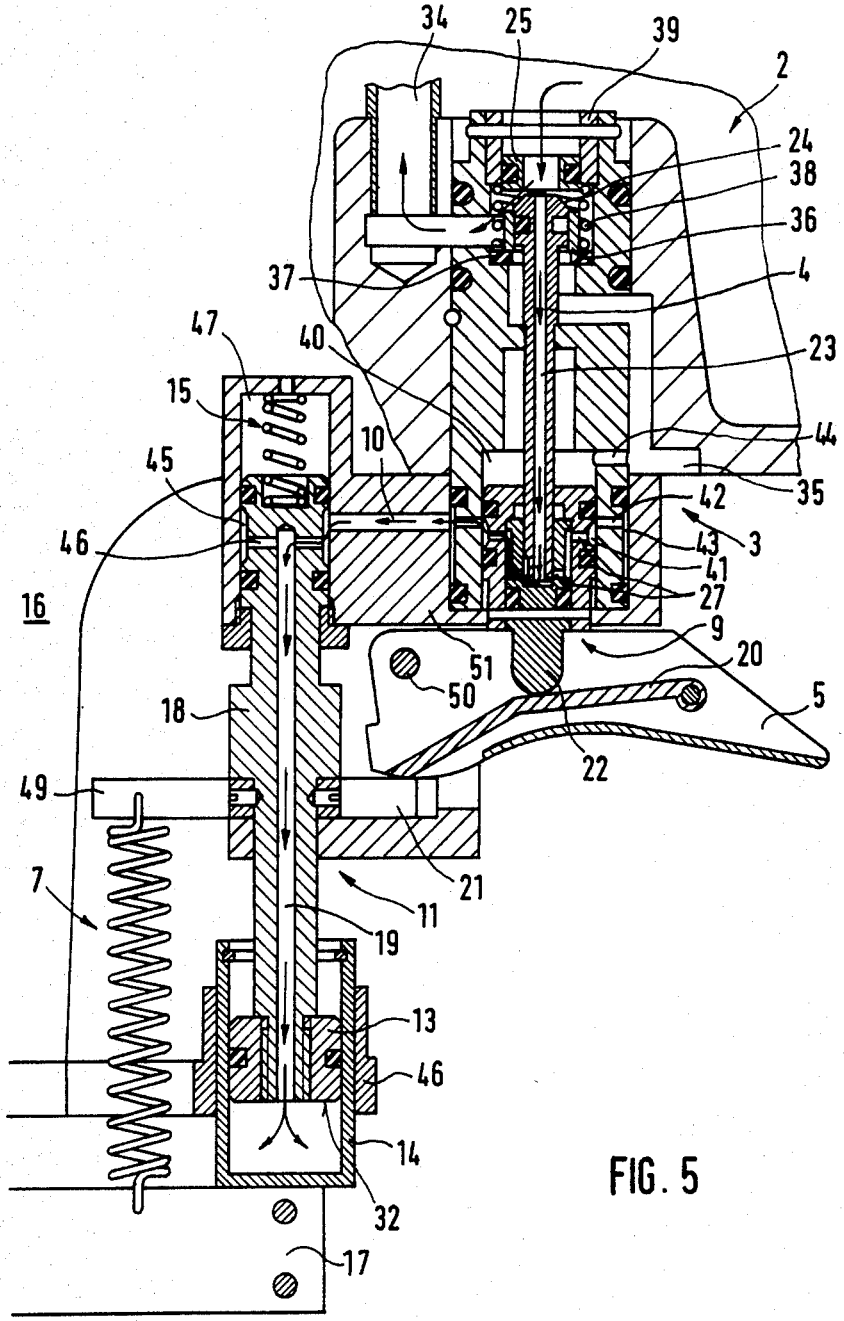
FIG. 5 is an enlarged illustration of the safety mechanism in a position prior to the shot, i.e. with the nose moved out.
Figure 6:
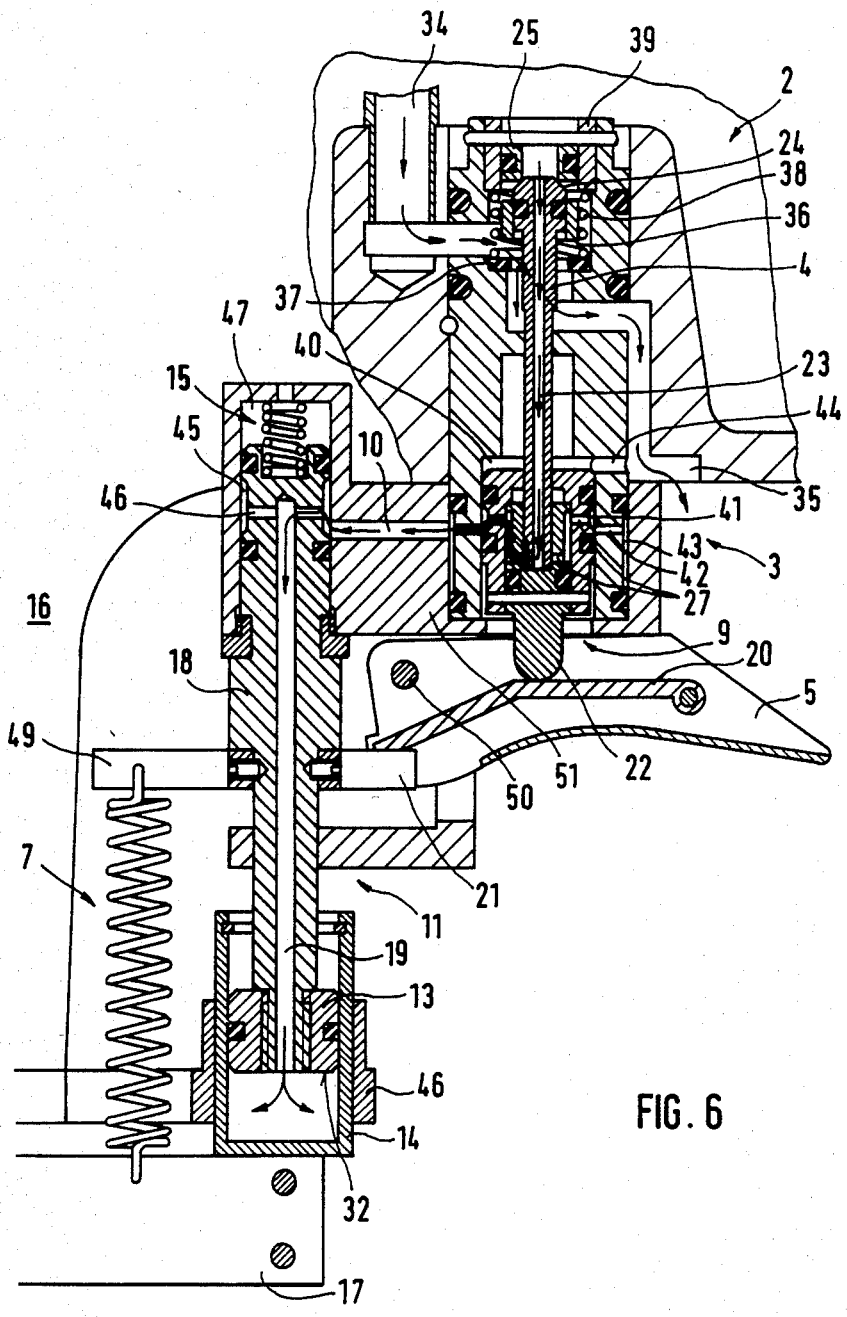
FIG. 6 is an enlarged illustration of the safety mechanism in the shooting position.

According to the invention, the control piston 4 is furnished with an axial longitudinal bore 23. At the upper end thereof it forms a sealing face 24 that in the resting position as shown in FIG. 4 is spaced from an associated sealing seat 25. Thereby a flow communication between the compressed air store space 2 and the connecting tube 34 is established. In this resting position, the control piston 4 with a further sealing face 36 pointing into an axial direction opposite to that of the sealing face abuts to a further sealing face 24 formed by a sealing ring 37 thereby discontinuing a flow communication between the connecting tube 34 and the venting duct 35. The sealing ring 37 is held by a compression spring 38 in a chamber receiving the upper end of the control piston 4 which compression spring 38 supports itself on the opposite side of an insert 39. With the bottom end thereof the elongated control piston 4 protrudes into a chamber 26 of an axially displaceable valve piston 22 of a safety valve arrangement 9. The safety valve piston 22 circumferentially is sealingly displaceable in a valve chamber 40 from a bottom resting position (FIG. 4) into a bottom and top operating position (FIGS. 5 and 6). Chamber 26 via radial bores 27 is in flow communication with an external peripheral groove 41 which in the resting position according to FIG. 4 does not have an outlet, while in the operating positions according to FIGS. 5 and 6 via radial bores 42 and a peripheral groove 43 is in flow communication with a connecting channels 10. In the resting position of the safety valve piston 22 according to FIG. 4, the radial bores 42 terminate in the upper exposed portion of the valve chamber 40 that, conversely, via a vent 44 is in communication with the atmosphere. In the resting position according to FIG. 4 the operating pressure of the compressed air store space 2 is maintained in the interior of the chamber 26 down to the external peripheral groove 41. The axial displacement of the safety valve piston 22 from the resting position according to FIG. 4 into the bottom operating position according to FIG. 5 is performed by manual operation of the control valve lever 5. In this axial displacement, a protruding lug of the control valve piston 22 supports itself on a swing strip 20 disposed in the control valve lever 5. In the axial displacement of the safety valve piston 22 from the resting position according to FIG. 4 into the bottom operating position according to FIG. 5, the control valve piston 4 is not entrained as the two of them are axially displaceable with respect to one another. In the bottom operating position of the safety valve piston 22 according to FIG. 5 the flow communication between the longitudinal bore 23 of the control piston 4 and the connecting channel 10 via chamber 26, radial bores 27, peripheral groove 41, radial bores 42 and peripheral groove 43 is established. The operating pressure of the compressed air store space 2 is thereby maintained in the connecting channel 10. The same terminates in a peripheral groove 45 of a piston rod 18 of a safety piston cylinder arrangement 11. Piston rod 18 at the bottom end thereof carries a safety piston 13 sealingly guided in a safety cylinder 14. Piston rod 18, moreover, includes an axial bore 19 protruding from the downwardly pointing front face 32 of the safety piston 13 down to the area of the peripheral groove 45 of the piston rod 18 with which it is in flow communication via radial bores 46. With the top end thereof piston rod 18 supports on a reset spring 15 disposed in a ventilated tool housing chamber 47, in which the top end of the piston rod 18 is guided in sealing manner. In the resting position shown in FIG. 4 the safety rod 13 with the front face 32 thereof abuts the lower face of safety cylinder 14 closed there. Safety cylinder 14 in a ring sleeve 146 of the tool housing 16 is disposed in axially displaceable manner and at the bottom thereof via an operating arm 17 is connected to a safety nose 6 displaceably disposed on mouthpiece 33. Safety nose 6 according to FIG. 1 is shown in the resting position of control valve 3, safety valve arrangement 9 and safety piston cylinder arrangement 11. Spring 7 according to FIG. 4 holds the nose in a retracted position in which the front nose and is in alignment with front end 8 of the output barrel that is identical with the bearing face 48 of the mouthpiece 33. Operating arm 17 via a reset spring 7 formed as a tension spring is connected to a lateral arm 49 of piston rod 18. Upon operation of the control valve lever 5 into the bottom operating position of the safety valve piston 22 of the safety valve assembly 9 as shown in FIG. 5 the operating pressures transferred into the axial bore via the connecting channel 10 now causes a displacement of cylinder 14 into the position as shown in FIG. 5 in the downward direction, and that against the action of reset spring 7 the reset force of which is lower than that of the reset spring 15 on which the rearward end of the piston rod 18 supports. Via the operating arm 17, the safety nose 6 is advanced to such an extent that with the forward end thereof it protrudes beyond the bearing face 48 of the mouthpiece 13. The illustration of FIG. 1 corresonds to the position of the valve arrangements according to FIG. 5. FIG. 5 reveals that the control valve lever 5 about its pivot axis 50 cannot be swung upwardly any further as it has found its stop at the valve casing 51. For this reason, first the control piston 4 cannot yet be displaced from its resting position shown in FIGS. 4 and 5 into the operating position according to FIG. 6. Only if mouthpiece 33 of the fastener driving tool 1 is placed onto an adequately solid and unresilient face 12, e.g. the surface of a wooden beam or the like, and pressed against it with an adequate force as shown in FIG. 3, the safety nose 6 moves into the pushed-back position according to FIG. 3, and thus the operating arm 17, the safety cylinder 14 and the safety piston 13 with the piston rod 18 move upwardly against the action of the reset spring 15 from the position shown in FIG. 5 into the shooting position according to FIG. 6. The cylinder chamber area of the safety cylinder 14 cleared under the safety piston 13 remains above the operating pressure of the compressed air store space 2, while the axial bore 19, the radial bores 46 and the peripheral groove 45 remain under the operating pressure of the compressed air store space 2 since the peripheral groove 45 has a corresponding width and also in the shooting position of the piston rod 18 according to FIG. 6 is still in flow communication with the connecting channel 10. With the axial upward movement of the piston rod 18 a lateral lug 21 is entrained upwardly. Lug 21 acts upon the swing strap 20 which, in turn, continues to push the safety valve piston 22 upwardly, and by the bottom face of chamber 26 of the safety valve piston 22 being touched by the lower end of the control piston 4 the same is pushed axially upwardly until sealing face 36 lifts off from the sealing ring 37 and sealing face 24 abuts sealing seat 25 thereby releasing the shot of the fastener driving tool 1 on account of the pressure relief of the pressure application chamber. Releasing the shot is thus possible only if after operation of the control valve lever 5 safety nose 6 strikes a surface 12 exhibiting an adequate resistance so that the force of the reset spring 15 is overcome. In connection with FIG. 2 the case has been described in which first the safety nose 6 via the bearing face 48 of the mouthpiece 33 is pushed forward and only then the fastener driving tool 1 according to FIG. 3 is pushed back onto surface 12 while pushing back the safety nose 6 against the action of the reset spring 15. However, the safety mechanism according to the invention also operates if prior to actuating the control valve lever 5 the fastener driving tool 1 with the bearing face 48 of the mouthpiece 33 is placed onto the corresponding surface 12 and only thereafter the manual operation is performed. Then the safety piston 13 and piston rod 18 under the operating pressure of the compressed air store space 2 push upwardly against the action of the reset spring 15 without changing the position of the safety nose 6 and thus of safety cylinder 14. This will prove that the force of the reset spring 15 is lower than the compressive force of operation as supplied by the compressed air space 2 to the front face 32 of the safety piston 13. Here, too, first the safety valve piston 22 through the control valve lever 5 is raised into a first operating position and then by means of the upwardly pushed lug 21 and swing strap 20 is displaced into the upper operating position according to FIG. 6 in which also control piston 4 is displaced into the upper releasing position. As shown by FIG. 6, control piston 4 at the bottom end thereof has groove-type recesses, which despite abutment of the bottom front face of the control piston 4 to the bottom of chamber 26 establish a flow communication between the longitudinal bore 23 and the radial bores 27 and hence the connecting channel 10 that remains open so that also in the upper operating position of the safety valve piston 22 the operating pressure from the compressed air store space 2 on the front face of the safety piston 13 is maintained.

After releasing the shot the operator lets the control valve lever 5 go, thereby first downwardly pushing control piston 4 under the action of the operating pressure of the compressed air store space 2 till the flow communication between compressed air space 2 and pressure application chamber via connecting tube 24 has been re-opened and the flow communication to the vent 35 has been closed again. Due to the pressure of the compressed air store space 2 maintained in the longitudinal bore 23 the safety valve piston 22 is pushed into its bottom resting position as shown in FIG. 4. In this manner, the connecting channel 10 is pressure relieved via valve chamber 40 and vent 44 so that under the action of the reset spring 15 the safety piston 13 and under the action of the reset spring 7 the safety cylinder 14 returns into its resting and starting position as shown in FIG. 4. The operating pressure maintained in the compressed air store space 2 can be adjusted to the required level by connecting the compressed air store space 2 via a connecting piece to a compressed air source.

In the embodiment of the invention according to FIGS. 7 through 9 the safety piston cylinder arrangement 11 essentially has the same buildup as that according to the former embodiment according to FIGS. 1 through 6, with the difference that the peripheral groove 45 is not in communication with a connecting channel 10 so the safety valve arrangement 9 but rather via a connecting channel 31 with a store space 29. The store space 29 via a special safety filling valve 28 is in communication with the compressed air store space 2. The safety filling valve 28 includes a valve pin 53 displaceable by a pressure of the finger against a reset spring 52 from the axial closing position according to FIG. *7a* into the axial open position according to FIG. *8a*. In the closing position according to FIG. *7a* the compressed air store space 2 is sealed against the store chamber 29. In the open position according to FIG. *8a*, a peripheral channel 54 of the valve pin 53 interconnects the connecting bores 55 and 56 of the partition so that the store chamber 29 can be brought to the operating pressure of the compressed air store space 2. Provided in an outer wall of the store chamber 29 is a throttle valve 30 having a throttle duct 57. By an adjustable valve body 58 the period of time over which the pressure of the store chamber 29 on the throttle duct 57 reduces, can be adjusted. In the illustration according to FIG. 7 the store chamber 29 is at zero pressure. After operation of the safety filling valve 29 according to FIG. 8*a* in the store chamber 29 the required operating pressure for the downward displacement of the safety cylinder 14 and hence of the safety nose 6 against the action of the reset spring 7 arises. The safety nose 6 thereby after the displacement of the safety cylinder 14 shown in FIG. 8 is advanced into the pushed-forward position according to FIG. 2. When applying the fastener driving tool 1 with the mouthpiece 33 to a surface 12 exhibiting an adequate resistance the safety nose 6, in turn, is urged against the action of the reset spring 15 into the shooting position as shown in FIG. 9. It is only by this that the swing strap 20 is moved into a position in which upon operation of the control valve lever 5 the control piston 4 via the lug protruding downwardly from the valve housing 51 can be pushed into the upper operating position. The release of a shot is thus possible only under the two conditions that, firstly, the required operating pressure prevails in the store chamber 29 and, secondly, the safety nose 6 against an adequate resistance is urged into the pushed-back position according to FIG. 3. As disclosed by FIGS. 7, 8 and 9, here, the control piston 4 need not have an axial bore, and in place of the safety valve assembly 9, a simple lug means 59 is provided that is screwed onto the bottom end of the control piston 4 and is guided in sealing manner in the valve housing 51.

What is claimed is:

1. A pneumatic fastener driving tool including a housing for high-pressure air, a cylinder in said housing, a driving piston in said cylinder and having a driver secured to said driving piston, which driver is guided in an output barrel, the improvement comprising a mechanism for controlling the operation of said tool to drive a fastener, said mechanism including a first valve means for controlling the flow of high-pressure air relative to said driving piston, a control assembly for controlling the operation of said first valve means, and a safety mechanism for controlling the operation of said control assembly, which safety mechanism regulates the operation of said first valve means to effect driving of a fastener when the output barrel is in engagement with a workpiece, and means for normally retaining the safety mechanism in an inoperative position when the tool is not being operated.

2. A pneumatic driving tool as set forth in claim 1 in which the safety mechanism includes a safety nose member adapted to be positioned to engage the workpiece and means normally biasing said safety nose member into a retracted position relative to said output barrel.

3. A fastener driving tool as set forth in claim 2 in which said safety mechanism includes a pressure responsive piston and cylinder assembly, means for controlling the flow of high-pressure air to said piston and cylinder assembly to oppose said biasing means seeking to maintain the safety mechanism in the retracted position to extend said safety nose, said control assembly being responsive to movement of said piston and cylinder assembly to effect operation of said first valve means to effect movement of the fastener driving piston in a driving direction.

4. A fastener driving tool as set forth in claim 3 in which said control means includes second valve means for controlling the flow of high-pressure air to said piston and cylinder assembly to move said safety mechanism into position to be engaged by a workpiece.

5. A fastener driving tool as set forth in claim 4 in which said second valve means is separate from said first valve means.

6. A fastener driving tool as set forth in claim 4 in which said second valve means is constructed and arranged to operate said first valve means and the control assembly is positioned to engage said second valve means whereby in response to movement of said control assembly the second valve means is positioned to introduce high-pressure air to the piston and cylinder assembly to move the safety mechanism into position to be engaged by a workpiece after which the first valve means is positioned to introduce high-pressure air to the driving piston to drive a fastener.

7. A fastener driving tool in accordance with claim 1 in which said safety mechanism includes an operating arm connected to a safety nose disposed adjacent said output barrel, a piston and cylinder assembly cooperating with said operating arm to move said safety mechanism outwardly to place the safety nose into position to be engaged by the workpiece, means on said piston and cylinder assembly for engaging said control assembly whereby when the safety nose is engaged with a workpiece said last mentioned means is moved to engage said control assembly to operate said first valve means to introduce high-pressure air to the driving piston to drive a fastener.

8. A pneumatic fastener driving tool including a housing for high-pressure air, a cylinder in said housing, a driving piston in said cylinder having a driver secured to said driving piston, which driver is guided in an output barrel; the improvement comprising a mechanism for controlling the operation of said tool to drive a fastener; said mechanism including a first valve means for controlling the flow of high-pressure air relative to said driving piston, a control assembly, and a safety mechanism for controlling the operation of said control assembly; said safety mechainsm comprising a piston and cylinder assembly, second valve means controlling the flow of high-pressure air to said piston and cylinder assembly, means on said piston on cylinder assembly for engaging said control assembly, a safety nose disposed adjacent the output barrel, and means for biasing the safety nose into an inoperative position relative to said output barrel, and means interconnecting said nose and piston and cylinder assembly; said control assembly including means for sequentially positioning said second valve means to introduce high-pressure air to said piston and cylinder assembly to bias said safety nose to an operative position whereby it is in position to be engaged by a workpiece whereupon said means on said piston and cylinder assembly engages said control asembly to move said first valve means to effect driving movement of said driving piston.

9. A tool as set forth in claim 8, in which said safety mechanism includes a first operating arm secured to said safety nose, and the piston and cylinder assembly includes a cylinder attached to said first operating arm, a second operating arm attached to said piston, stop means for limiting outward movement of said second operating arm, said biasing means includes tension spring means for biasing said first operating arm to maintain said safety nose in an inoperative position, said control assembly including a trigger contacted by said second operating arm to operate said second valve means to effect movement of said cylinder and attached first operating arm to move the nose into work-engaging position and when said nose engages a workpiece to operate said first valve means to introduce high-pressure air to operate the driving piston to drive a fastener.

* * * * *